US005565312A

United States Patent [19]

Jain

[11] Patent Number: 5,565,312

[45] Date of Patent: Oct. 15, 1996

[54] PHOTOGRAPHIC ELEMENTS CONTAINING MAGENTA DYE FORMING COUPLERS AND FADE REDUCING COMPOUNDS-L

[75] Inventor: Rakesh Jain, Penfield, N.Y.

[73] Assignee: Eastman Kodak Company, Rochester, N.Y.

[21] Appl. No.: 428,984

[22] Filed: Apr. 26, 1995

[51] Int. Cl.[6] ..... G03C 7/392; G03C 7/38

[52] U.S. Cl. ..... 430/551; 430/558

[58] Field of Search ..... 430/558, 551, 430/546

[56] References Cited

U.S. PATENT DOCUMENTS 5,082,766 1/1992 Nishijima et al. ..... 430/551
5,236,819 8/1993 Kadokura et al. ..... 430/551
5,418,118 5/1995 Edwards et al. ..... 430/558

FOREIGN PATENT DOCUMENTS 3095448 4/1988 Japan ..... 430/551
3101848 5/1988 Japan ..... 430/551

*Primary Examiner*—Lee C. Wright
*Attorney, Agent, or Firm*—Joshua G. Levitt

[57] ABSTRACT

Dye fade in photographic images prepared from a silver halide photographic element having a light sensitive silver halide emulsion layer and a pyrazoloazole dye forming coupler is reduced by using a combination of stabilizer compounds as shown in the specification.

10 Claims, No Drawings

PHOTOGRAPHIC ELEMENTS CONTAINING MAGENTA DYE FORMING COUPLERS AND FADE REDUCING COMPOUNDS-L

FIELD OF THE INVENTION

This invention relates to photographic elements containing particular magenta dye forming couplers associated with compounds which reduce fading of the dyes formed from the couplers on processing of the photographic element.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

The dyes that are formed by any color coupler during processing have a tendency to fade over time as a result of exposure to light, heat and humidity. As all three image dyes of a typical color element fade, this results in overall fading of the image over time. In addition, since the three image dyes may not fade at the same rate, an apparent change in image color may result. Such change is particularly noticable in the case of magenta image dye fading.

A variety of magenta dye-forming coupler types have been used in photographic materials. Among the known magenta dye-forming couplers are cyclic azoles such as pyrazolotriazoles, pyrazolobenzimidazoles, and imidazopyrazoles. These couplers contain bridgehead nitrogen 5,5 fused ring systems and include such couplers as pyrrolo[1,2-b]pyrazoles, pyrazolo[3,2c][1,2,4]triazoles, pyrazolo[2,3-b][1,2,4]triazoles, imidazo[1,2 -b]pyrazoles, imidazo[1,5 -b ]pyrazoles, imidazo[1,2 -a]imidazoles, imidazo[1,2-b ][1,2,4]triazoles, imidazo[2,1-c][1,2,4]triazoles, imidazo[5,1 -c][1,2,4]triazoles and [1,2,4]triazolo[3,4-c][1,2,4]triazole.

A significant disadvantage of pyrazoloazole couplers is fading of the dyes formed from them by photographic processing due to extended exposure to low levels of light. Compounds which are included in photographic elements to reduce image dye fading are known as stabilizers. Inclusion of stabilizers in color photographic materials can reduce the deterioration of the dye images which occurs over time as a result of the action of light, heat or humidity. This is true for dyes formed from pyrazoloazole couplers. U.S. Pat. Nos. 5,236,819 and 5,082,766 describe the use of certain stabilizers with pyrazoloazole couplers to improve their dye stability. However, it would be desirable to further improve the light stability of dyes derived from cyclic azole magenta dye forming couplers, and thus retain the color rendition of the image for a longer period of time.

SUMMARY OF THE INVENTION

We have found that highly stable magenta dye images formed from cyclic azole magenta couplers can be obtained if there is associated with the coupler a combination stabilizer compounds R, S and L, shown below.

The present invention therefore provides a silver halide photographic element comprising a support bearing a light sensitive silver halide emulsion layer and a cyclic azole magenta dye forming coupler associated with a stabilizer combination comprising:

i) a compound having the following Formula R:

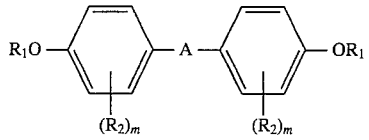

ii) a compound having the following Formula S:

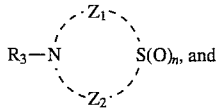

iii) a compound having the following Formula L:

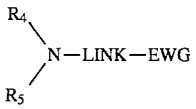

wherein:

each $R_1$ independently represents a hydrogen atom, an alkyl group, an alkenyl group or an aryl group;

each $R_2$ independently represents a halogen atom, an alkyl group, an alkenyl group an alkoxy group, an aryl group, an aryloxy group, an alkylthio group, an aryl thio group, an acyl group, an an acylamino group, a sulfonyl group, a sulfonamide group or a hydroxy group;

each m is, individually an integer of 0 to 4;

A represents an alkylene group having 1 to 6 carbon atoms in its linear structure;

$R_3$ represents an aryl group or a heterocyclic group;

$Z_1$ and $Z_2$ each represent an alkylene group having 1 to 3 carbon atoms provided that the total number of carbon atoms in the ring is 3 to 6;

n is an integer of 1 or 2;

$R_4$ and $R_5$ each, independently, represents hydrogen, alkyl of 1 to 32 carbon atoms, aryl of 6 to 10 carbon atoms, acyl or acylamino of 2 to 32 carbon atoms, provided that $R_4$ and $R_5$ are not both hydrogen, or, taken together, $R_4$ and $R_5$ form a cyclic ring system;

Link represents a straight or branched alkylene group having 1 to 6 carbon atoms in its linear structure and EWG represents an electron withdrawing group.

Photographic elements of the present invention yield magenta dye images that have low fading when exposed to light.

DETAILED DESCRIPTION OF THE INVENTION

As used herein, unless otherwise indicated the alkyl and aryl groups, and the alkyl and aryl portions of groups, can be unsubstituted or substituted with non-interfering substituents. Typical alkyl groups have 1 to 32 carbon atoms and typical aryl groups have 6 to 32 carbon atoms. Depending upon the position of the group, preferred alkyl groups can have 1 to 20 carbon atom, 1 to 12 carbon atoms or 1 to 4 carbon atoms and preferred aryl groups can have 6 to 20 or 6 to 10 carbon atoms. Other groups identified below which contain a replacable hydrogen atom can be substituted or not, depending on the particular structure and properties desired.

The magenta dye forming couplers of this invention can be based on any of the bridgehead nitrogen 5,5 fused ring system identified above. Preferred couplers are pyrazolotriazoles represented by Formula II:

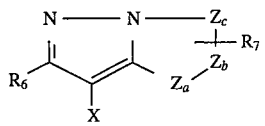

Formula II wherein:

$R_6$ is hydrogen or a substituent;

$R_7$ is a ballast group; and

X is hydrogen or a coupling-off-group; and $Z_a$, $Z_b$, and $Z_c$ are independently a substituted or unsubstituted methine group, =N—,

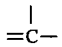

or —NH—, provided that one of either the $Z_{a—Zb}$ bond or the $Z_{b—Zc}$ bond is a double bond and the other is a single bond, and when the $Z_b$—$Z_c$ bond is a carbon-carbon double bond, it can be part of the aromatic ring and at least one of $Z_a$, $Z_b$, and $Z_c$ represents a methine group connected to $R_7$.

Preferred pyrazolotriazole couplers of this invention are 1H-pyrazolo[2,3-b][1,2,4]triazoles represented by Formula III:

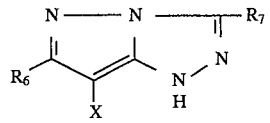

Formula III wherein:

X, $R_6$ and $R_7$ are as previously defined.

Examples of suitable $R_6$ groups are alkyl, which can be straight or branched, such as methyl, ethyl, n-propyl, n-butyl, t-butyl, trifluoromethyl, tridecyl or 3-(2,4-di-t-amylphenoxy)propyl; alkoxy, such as methoxy or ethoxy; alkylthio, such as methylthio or octylthio; aryl, aryloxy or arylthio, such as phenyl, 4 -t-butylphenyl, 2,4,6-trimethylphenyl, phenoxy, 2 -methylphenoxy, phenylthio or 2-butoxy-5-t-octylphenylthio; heterocyclyl, heterocyclyloxy or heterocyclylthio, each of which contain a 3 to 7 membered heterocyclic ring composed of carbon atoms and at least one hetero atom selected from oxygen, nitrogen and sulfur, such as 2-furyl, 2-thienyl, 2 -benzimidazolyloxy or 2-benzothiazolyl; cyano; acyloxy, such as acetoxy or hexadecanoyloxy; carbamoyloxy, such as N-phenylcarbamoyloxy or N-ethylcarbamoyloxy; silyloxy, such as trimethylsilyloxy; sulfonyloxy, such as dodecylsulfonyloxy; acylamino, such as acetamido or benzamido; anilino, such as phenylanilino or 2 -chloroanilino; ureido, such as phenylureido or methylureido; imido, such as N-succinimido or 3 -benzylhydantoinyl; sulfamoylamino, such as N,N-dipropyl-sulfamoylamino or N-methyl-N-decylsulfamoylamino; carbamoylamino, such as N-butylcarbamoylamino or N,N-dimethylcarbamoylamino; alkoxycarbonylamino, such as methoxycarbonylamino or tetradecyloxycarbonylamino; aryloxycarbonylamino, such as phenoxycaronylamino, 2,4-di-t-butylphenoxycarbonylamino; sulfonamido, such as methanesulfonamido or hexadecanesulfonamido; carbamoyl group, such as N-ethylcarbamoyl or N,N-dibutylcarbamoyl; acyl, such as acetyl or (2,4-di-t-amylphenoxy)acetyl; sulfamoyl, such as N-ethylsulfamoyl or N,N-dipropylsulfamoyl; sulfonyl, such as methanesulfonyl or octanesulfonyl; sulfinyl, such as octanesulfinyl or dodecylsulfinyl; alkoxycarbonyl, such as methoxycarbonyl or butyloxycarbonyl; aryloxycarbonyl, such as phenyloxycarbonyl or 3 -pentadecyloxycarbonyl; alkenyl; hydroxyl; amino; and carbonamido groups.

Preferably, $R_6$ represents a tertiary alkyl group of 4 to 12 carbon atoms. Most preferably it represents t-butyl.

The ballast group represented by $R_7$ is a group of such size and configuration that, in combination with the remainder of the molecule, it provides the coupler, and the dye formed from it, with sufficient bulk that it is substantially non-diffusible from the layer in which it is coated in the photographic element. Representative ballast groups include alkyl or aryl groups containing 6 to 32 carbon atoms. Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, and arylphosphonyl. Preferably $R_7$ is an alkyl group of 6 to 32 carbon atoms Possible substituents for $R_6$ and $R_7$ include halogen, alkyl, aryl, aryloxy, heterocyclyl, cyano, alkoxy, acyloxy, carbamoyloxy, silyloxy, sulfonyloxy, acylamino, anilino, ureido, imido, sulfonylamino, carbamoylamino, alkylthio, arylthio, heterocyclylthio, alkoxycarbonylamino, aryloxycarbonylamino, sulfonamido, carbamoyl, acyl, sulfamoyl, sulfonyl, sulfinyl, alkoxycarbonyl, aryloxycarbonyl, alkenyl, carboxyl, sulfo, hydroxyl, amino and carbonamido groups.

The coupling off group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo.

Preferably, X is hydrogen or halogen. Most preferably X is hydrogen or chlorine.

Specific couplers within the scope of the present invention have the following structures:

M-1
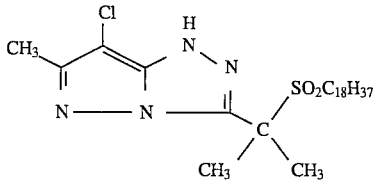
M-2
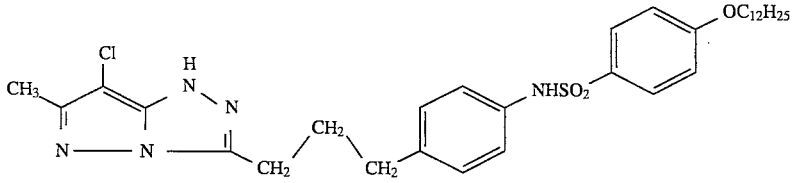
M-3
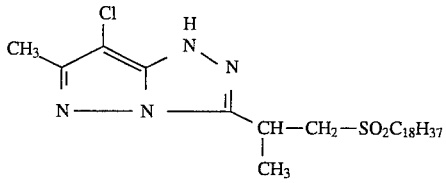
M-4
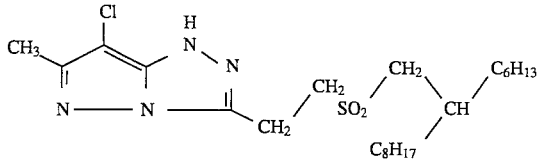
M-5
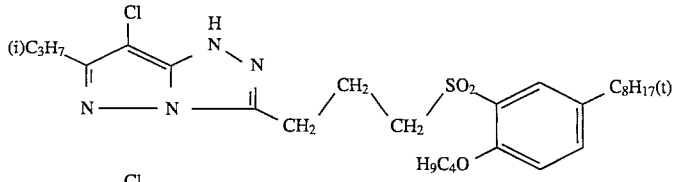
M-6
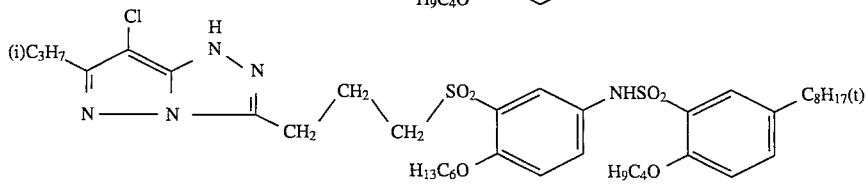
M-7
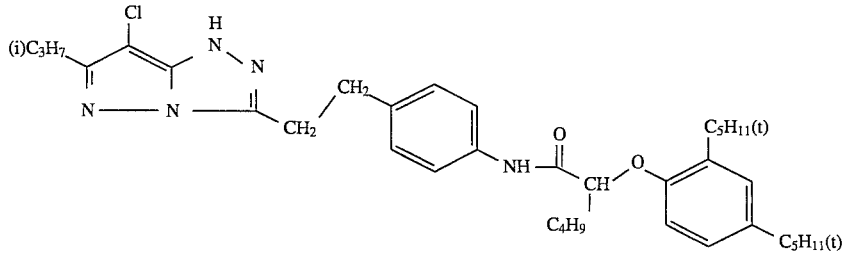
M-8
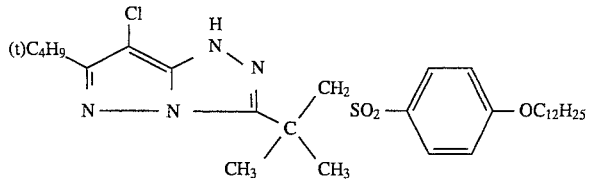
M-9
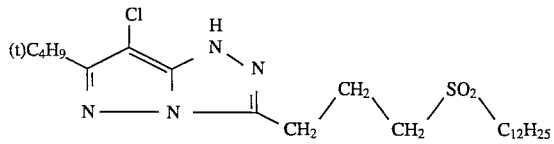

-continued

M-10

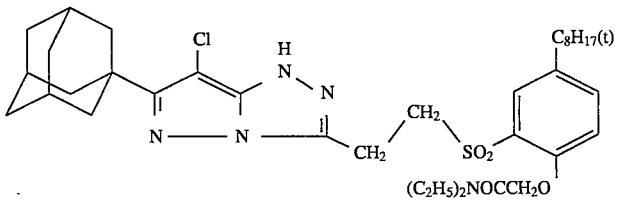

M-11

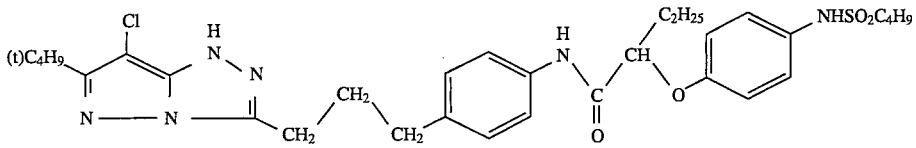

M-12

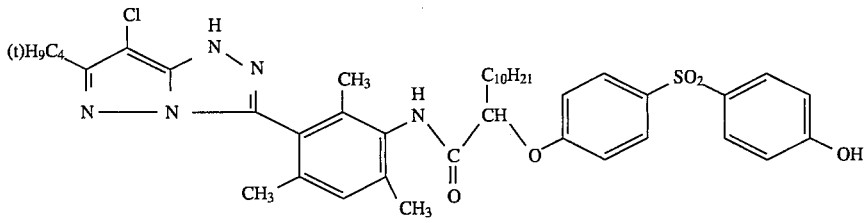

M-13

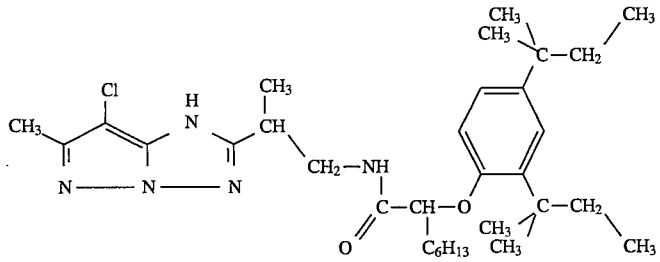

M-14

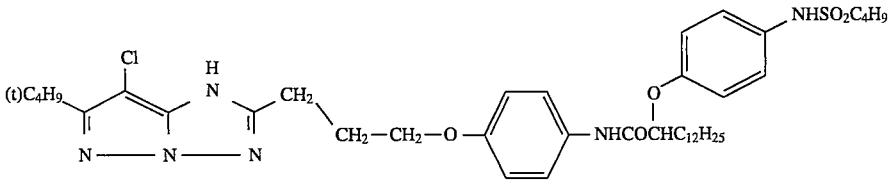

M-15

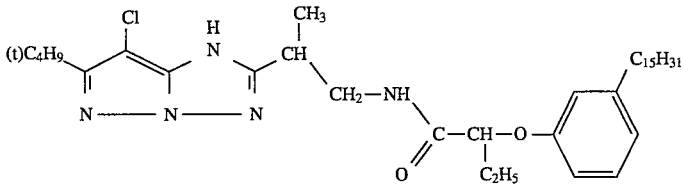

M-16

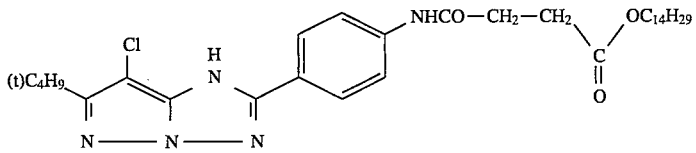

The stabilizers that have the Formula R, above, are believed to stabilize the dye image by scavenging free radicals. In this formula, the group represented by A is a straight, branched or cyclic alkylene group, the linear portion of which has 1 to 6 carbon atoms, which can be substitituted with one or more aryl, cyano, halogen, heterocyclyl, cycloalkyl, alkoxy, hydroxy, and aryloxy groups. The alkylene group can form a cycloalkyl ring, such as

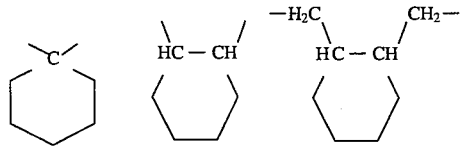

In Formula R, each $R_1$ can be a group as defined above for $R_6$ or $R_7$ in Formula III. These include halogen, alkyl, cycloalkyl, alkenyl, alkoxy, aryl, aryloxy, alkylthio, arylthio, acyl, acylamino, sulfonyl and sulfonamido.

Preferred compounds represented by Formula R, are those in which:

each $R_1$ independently is hydrogen, alkyl or cycloalkyl of 1 to 8 carbon atoms;

each $R_2$ is independently hydrogen, hydroxy, alkyl or alkoxy of 1 to 8 carbon atoms;

each m is an integers of 0 to 2; and

A is an alkylene group of 1 to 10 carbon atoms.

Representative examples of stabilizer compounds which satisfy Formula R are:

R-1

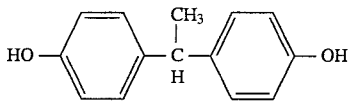

R-2

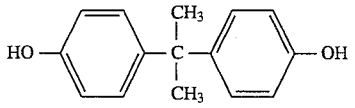

R-3

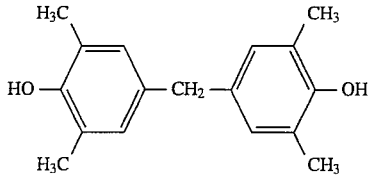

R-4

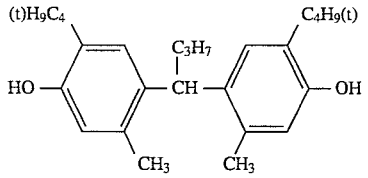

R-5

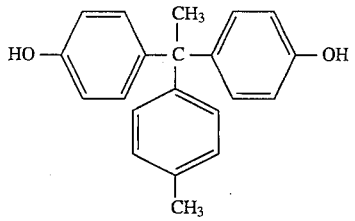

R-6

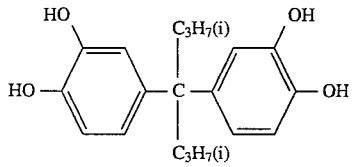

The stabilizers that have the Formula S, above are believe to stabilize by acting as singlet oxygen quenchers. In this formula the aryl and heterocyclic group represented by $R_3$ include phenyl, 1-naphthyl, 2-furyl and 2-thienyl. They can be substituted with groups described above in Formula III for $R_6$, as can be the alkylene groups represented by $Z_1$ and $Z_2$.

Preferred stabilizers represented by Formula S, are those having the following Formula S1:

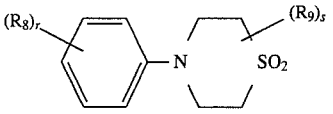

wherein:

$R_8$ represents alkyl, alkoxy, alkylthio, amido, ureido, or halogen;

$R_9$ is alkyl;

r is an integer of 1 or 2; and s is an integer of 0 to 4.

Representative examples of stabilizer having the Formula S are:

S-1

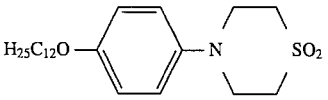

S-2

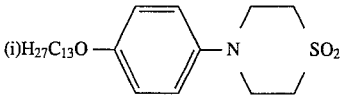

S-3

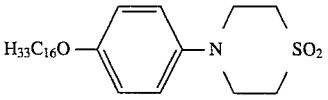

S-4

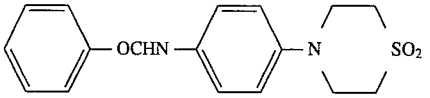

S-5

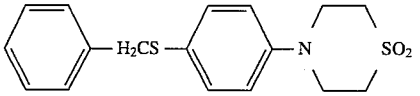

S-6

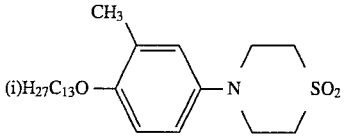

S-7

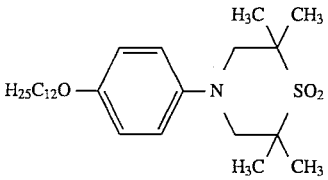

S-8

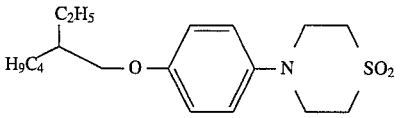

The stabilizers that have the Formula L, above, are known compounds but have not been known to act as stabilizers for dyes derived from couplers in photographic elements, especially magenta dyes formed from cyclic azole couplers.

In the stabilizer of Formula L:

R4 and R5, each, independently are hydrogen, alkyl, aryl as defined above, or represent the atoms that together with the nitrogen to which they are attached complete a heterocyclic nitrogen ring or ring system such as a [3.2.1]ring system;

Link represents an alkylene group of 1 to 6 carbon atoms as defined above for A; and EWG represents an electron withdrawing group having a Hammett sigma p value greater than 0, such as cyano, carboxy, sulfoxy, keto, and the like.

In a particularly preferred embodiment of compound L:

one of $R_4$ and $R_5$ is hydrogen and the other is alkyl of 6 to 32 carbon atoms;

LINK is an alkylene group of 2 to 6 carbon atoms, and

EWG is cyano, alkoxycarbonyl or alkylcarbonyl, the alkyl portions of which have 1 to 6 carbon atoms.

Representative examples of the stabilizers of formula L are:

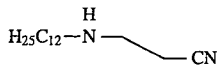
L-1

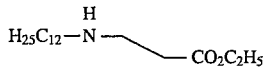
L-2

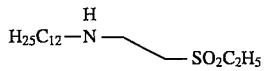
L-3

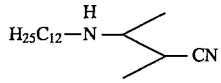
L-4

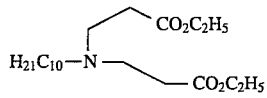
L-5

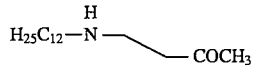
L-6

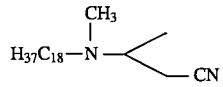
L-7

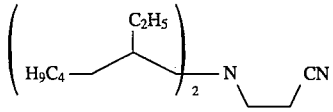
L-8

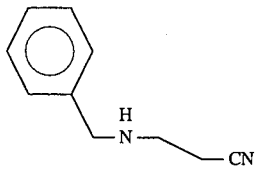
L-9

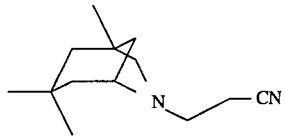
L-10

Typically, the couplers and the stabilizers with which they are associated are dispersed in the same layer of the photographic element in a high boiling organic compound known in the art as a coupler solvent. Representative coupler solvents include phthalic acid alkyl esters such as dibutyl phthalate and dioctyl phthalate, phosphoric acid esters such as tricresyl phosphate, diphenyl phosphate, tris-2-ethylhexyl phosphate, and tris-3,5,5-trimethylhexyl phosphate, citric acid esters such as tributyl acetylcitrate, benzoic acid esters such as octyl benzoate, aliphatic amides such as N,N-diethyl lauramide, and alkyl phenols such as 2,4-di-t-butyl phenol. Especially preferred coupler solvents are the phthalate esters, which can be used alone or in combination with one another or with other coupler solvents. Selection of the correct coupler solvent has been found to have an influence both on the hue of the dye formed on coupling as well as on its stability.

Throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The coupler and stabilizer compounds of the present invention are known compounds and can be prepared by techniques known to those skilled in the art. References which describe the preparation of the magenta dye forming couplers are the patents and published applications referred to above as describing these compounds, and references cited therein. The preparation of Stabilizer Compounds R and S is described in U.S. Pat. No. 5,236,819 and references cited therein. The synthesis of Stabilizer Compound L is easily accomplished by methods known to those skilled in the art, such as by reacting a suitably substituted amine with an activated alkene, for example, with acrylonitrile.

Typically the amount of each of compound R compound S and compound L will range from about 0.2 to about 3.0 moles stabilizer per mole of coupler, preferably from about 0.5 to 1.5 moles stabilizer per mole of coupler. The pyrazoloazole coupler, is typically coated in the element at a coverage of from 0.25 mmol/$m^2$ to 1.0 mmol/$m^2$, and preferably at a coverage of from 0.40 to 0.70 mmol/$m^2$. When a coupler solvent is employed, it typically is present in an amount of 0.50 to 5.0 mg. per mg. coupler, and preferably in an amount of 1.0 to 3.0 mg. per mg. coupler.

The photographic elements of this invention can be black and white elements (for example, using magenta, cyan and yellow dye forming couplers), single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Specific elements can be those shown on pages 96–98 of this Research Disclosure item as Color Paper Elements 1 and 2, in which is employed in the magenta dye forming layers the stabilizer combinations of the the present invention instead of the stabilizers shown there. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093, 662; 90/093,663; 90/093,664; 90/093,665; 90/093,666; 90/093,668; 90/094,055; 90/094,056; 90/101,937; 90/103,409; 90/151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydispersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, N.Y., 1977. In the case of processing a negative working element, th element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are:4-amino N,N-diethylaniline hydrochloride, 4-amino-3-methyl-N,N-diethylaniline hydrochloride, 4-amino-3-methyl-N-ethyl-N-(β-(methanesulfonamido)ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The stabilizers of this invention can be used in photographic elements that are intended to be processed in amplification processes that use developer/amplifier solutions described in U.S. Pat. No. 5,324,624, for example. When processed in this way, the low volume, thin tank processing system and apparatus described in U.S. patent application Ser. No. 08/221,711, filed Mar. 31, 1994, preferably is employed.

The following examples further illustrate this invention.

EXAMPLE 1

Photographic Evaluation

Dispersions of the coupler and stabilizers were prepared in the following manner. In one vessel there was combined coupler, coupler solvents, stabilizer(s), and ethyl acetate and the combination was warmed to dissolve. In a second vessel, the gelatin, surfactant (Alkanol XC™ from E.I. dupont Co.) and water were combined and passed three times through a Gaulin colloid mill. The ethyl acetate was removed by evaporation and water was added to restore the original weight after milling.

Photographic elements were prepared by coating the following layers in the order listed on a resin-coated paper support:

| | |
|---|---|
| 1st layer | |
| Gelatin | 3.23 g/m$^2$ |
| 2nd layer | |
| Gelatin | 1.61 g/m$^2$ |
| Coupler M-9 | 0.22 g/m$^2$ |
| Dibutyl phthalate coupler solvent | 0.16 g/m$^2$ |
| Diethylhexyl phthalate coupler solvent | 0.16 g/m$^2$ |
| Stabilizer R-4 | 0.18 g/m$^2$ |
| Stabilizer S-8 | 0.18 g/m$^2$ |
| Stabilizer L-1 | 0.09 g/m$^2$ |
| Green sensitized AgCl emulsion | 0.17 g/m$^2$ |
| 3rd layer | |
| Gelatin | 1.34 g/m$^2$ |
| 2-(2H-benzotriazol-2-yl)-4,6-bis-(1,1-dimethylpropyl)phenol | 0.73 g/m$^2$ |
| Tinuvin 326 ™ (Ciba-Geigy) | 0.13 g/m$^2$ |
| 4th layer | |
| Gelatin | 1.40 g/m$^2$ |
| Bis(vinylsulfonylmethyl)ether | 0.14 g/m$^2$ |

The photographic elements were given stepwise exposures to green light and processed at 35° C. as follows:

| | |
|---|---|
| Developer | 45 sec. |
| Bleach-Fix | 45 sec. |
| Wash (running water) | 1 min. 30 sec. |

The developer and bleach-fix had the following compositions:

| | |
|---|---|
| Developer | |
| Water | 700.00 mL |
| Triethanolamine | 12.41 g |
| Blankophor REU ™ (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 +/− 0.05 | |
| Bleach-Fix | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.5 ± 0.1 | |

Magenta dyes were formed upon processing. The following photographic characteristics were determined:

$D_{max}$ (the maximum density to green light);

Speed (the relative log exposure required to yield a density to green light of 1.0);

Contrast (the ratio (S-T)/0.6, where S is the density at a log exposure 0.3 units greater than the Speed value and T is the density at a log exposure 0.3 units less than the Speed value).

Elements which had been exposed and processed to provide a Status A green density of 1.0 and 1.7 were irradiated with a 50 klux high intensity daylight (HID) for 3 weeks. The change in density as a result of irradiation was measured at the end of 3 weeks or at the end of 2 weeks and again at the end of 3 weeks. This data shows that the stabilizer combinations of this invention provide an improvement in the light stability compared with a combination that does not contain Stabilizer L.

TABLE I

| | Coup. | Stab. S | Stab. R | Stab. L | 2 wk. fade | 3 wk. fade |
|---|---|---|---|---|---|---|
| Comparison | M-9 | S-8 | R-4 | | −0.19 | −0.35 |
| Invention | M-9 | S-8 | R-4 | L-1 | −0.14 | −0.27 |

EXAMPLE 2

Example 1 was repeated, except that the coupler used was M-11 and the composition of the 2nd layer was as follows:

| 2nd layer | |
|---|---|
| Gelatin | 1.61 g/m$^2$ |
| Coupler M-11 | 0.36 g/m$^2$ |
| Dibutyl phthalate coupler solvent | 0.36 g/m$^2$ |
| Diethylhexyl phthalate coupler solvent | 0.36 g/m$^2$ |
| Stabilizer R-4 | 0.18 g/m$^2$ |
| Stabilizer S-8 | 0.18 g/m$^2$ |
| Stabilizer L-1 | 0.09 g/m$^2$ |
| Green sensitized AgCl emulsion | 0.17 g/m$^2$ |

The light fade data are shown in Table II.

TABLE II

| | Coup. | Stab. S | Stab. R | Stab. L | 50 klux Daylight 3 wk fade from 1.0 | 1.7 |
|---|---|---|---|---|---|---|
| Comparison | M-11 | S-8 | R-4 | | −0.36 | −0.53 |
| Invention | M-11 | S-8 | R-4 | L-1 | −0.31 | −0.47 |

EXAMPLE 3

Example 1 was repeated, except that the composition of the 2nd layer was as follows:

| 2nd layer | |
|---|---|
| Gelatin | 1.61 g/m$^2$ |
| Coupler M-9 | 0.29 g/m |
| Dibutyl phthalate coupler solvent | 0.24 g/m$^2$ |
| Diethylhexyl phthalate coupler solvent | 0.24 g/m$^2$ |
| Stabilizer R-4 (see Table) | 0.18 g/m$^2$ |
| Stabilizer S-8 (see Table) | 0.18 g/m$^2$ |
| Stabilizer L-1 | 0.09 g/m$^2$ |
| Green sensitized AgCl emulsion | 0.17 g/m$^2$ |

The light fade data are shown in Table III.

TABLE III

| | Coup. | Stab. S | Stab. R | Stab. I | 50 klux Daylight 3 wk fade from 1.0 | 1.7 |
|---|---|---|---|---|---|---|
| Comparison | M-9 | | | L-1 | −0.77 | −1.16 |
| Comparison | M-9 | | R-4 | L-1 | −0.49 | −0.80 |
| Comparison | M-9 | S-8 | | L-1 | −0.33 | −0.44 |
| Comparison | M-9 | S-8 | R-4 | | −0.33 | −0.41 |
| Invention | M-9 | S-8 | R-4 | L-1 | −0.27 | −0.36 |

The invention has been described by reference to preferred embodiments, but it will be understood changes can be made to the embodiments specifically described herein within the spirit and scope of the invention.

What is claimed is:

1. A silver halide photographic element comprising a support bearing a light sensitive silver halide emulsion layer and a cyclic azole magenta dye forming coupler associated with a stabilizer combination comprising:

i) a compound having the following Formula R:

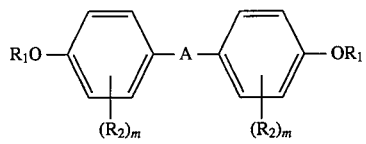

ii) a compound having the following Formula S:

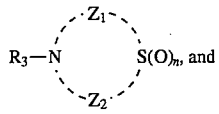

iii) a compound having the following Formula L:

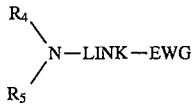

wherein:

each $R_1$ independently represents a hydrogen atom, an alkyl group, an alkenyl group or an aryl group;

each $R_2$ independently represents a halogen atom, an alkyl group, an alkenyl group an alkoxy group, an aryl group, an aryloxy group, an alkylthio group, an aryl thio group, an acyl group, an an acylamino group, a sulfonyl group, a sulfonamide group or a hydroxy group;

each m is, individually an integer of 0 to 4;

A represents an alkylene group having 1 to 6 carbon atoms in its linear structure;

$R_3$ represents an aryl group or a heterocyclic group;

$Z_1$ and $Z_2$ each represent an alkylene group having 1 to 3 carbon atoms provided that the total number of carbon atoms in the ring is 3 to 6;

n is an integer of 1 or 2;

one of $R_4$ and $R_5$ is hydrogen and the other is alkyl of 1 to 32 carbon atoms, aryl of 6 to 10 carbon atoms, acyl or acylamino of 2 to 32 carbon atoms;

Link represents a straight or branched alkylene group having 1 to 6 carbon atoms in its linear structure; and EWG represents an electron withdrawing group.

2. A photographic element of claim 1, wherein the magenta dye forming coupler has the structure:

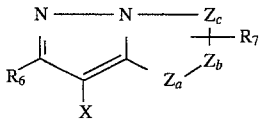

Formula II wherein:

$R_6$ is hydrogen or a substituent;

$R_7$ is a ballast group; and

X is hydrogen or a coupling-off-group; and $Z_a$, $Z_b$, and $Z_c$ are independently a substituted or unsubstituted methine group, =N—, $$=\overset{|}{C}-$$

or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it can be part of the aromatic ring and at least one of $Z_a$, $Z_b$, and $Z_c$ represents a methine group connected to $R_7$.

3. A photographic element of claim 2, wherein the magenta dye forming coupler has the structure:

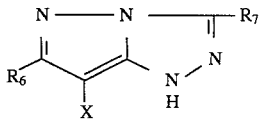

Formula III wherein:

$R_6$ is hydrogen or a substituent;

$R_7$ is a ballast group; and

X is hydrogen or a coupling-off-group.

4. A photographic element of claim 3, wherein $R_6$ is a t-alkyl group.

5. A photographic element of claim 1, wherein in compound L:

one of $R_4$ and $R_5$ is hydrogen and the other is alkyl of 6 to 32 carbon atoms;

LINK is an alkylene group of 2 to 6 carbon atoms, and

EWG is cyano, alkoxycarbonyl or alkylcarbonyl, the alkyl portions of which have 1 to 6 carbon atoms.

6. A photographic element of claim 1, wherein compound L has a structure selected from:

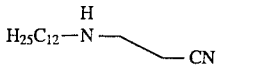

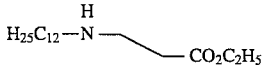

and

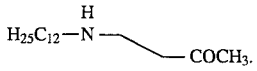

7. A photographic element of claim 1, wherein compound S has the structure:

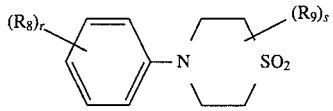

wherein:

$R_8$ represents alkyl, alkoxy, alkylthio, amido, ureido, or halogen;

$R_9$ is alkyl;

r is an integer of 1 or 2; and s is an integer of 0 to 4; and compound R has the structure:

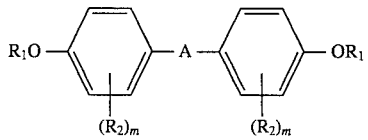

wherein each $R_1$ independently is hydrogen, alkyl or cycloalkyl of 1 to 8 carbon atoms;

each $R_2$ is independently hydrogen, hydroxy, alkyl or alkoxy of 1 to 8 carbon atoms;

each m is an integers of 0 to 2; and

A is an alkylene group of 1 to 10 carbon atoms.

8. A photographic element of claim 1, wherein each of compounds R, S and L are present in a range of about 0.2 to 2.0 moles compound per mole magenta dye forming coupler.

9. A photographic element of claim 1, further comprising a phthalate ester coupler solvent.

10. A photographic element of claim 1, wherein the support is opaque.

* * * * *